United States Patent [19]

Lycett

[11] Patent Number: 4,854,335

[45] Date of Patent: Aug. 8, 1989

[54] HAIR CURLER SYSTEM

[76] Inventor: Norma Lycett, 1007 E. Orange Dr., Phoenix, Ariz. 85014

[21] Appl. No.: 159,550

[22] Filed: Feb. 19, 1988

[51] Int. Cl.[4] ..... A45D 2/08

[52] U.S. Cl. ..... 132/247; 132/250

[58] Field of Search ..... 132/250, 247, 261

[56] References Cited

U.S. PATENT DOCUMENTS

| | | | |
|---|---|---|---|
| 757,241 | 4/1904 | Stone | 132/247 |
| 1,085,083 | 1/1914 | Grosert | 132/245 |
| 1,896,617 | 2/1933 | Goodman | 132/ |
| 1,945,932 | 2/1934 | Caley | 132/44 |
| 2,028,234 | 1/1936 | Natkiel et al. | 132/43 |
| 2,064,312 | 12/1936 | McFadden | 132/41 |
| 2,137,595 | 11/1938 | Stubbs et al. | 132/247 |
| 2,169,021 | 8/1939 | Caldora | 132/41 |
| 2,213,231 | 9/1940 | Swanson | 132/41 |
| 2,243,397 | 5/1941 | Schwab | 132/33 |
| 2,319,658 | 5/1943 | Caldora | 132/33 |
| 2,507,356 | 5/1950 | Steiner et al. | 132/247 |
| 2,537,728 | 1/1951 | Wright | 132/42 |
| 2,558,305 | 6/1951 | Marvin | 132/261 |
| 2,565,673 | 8/1951 | Yven et al. | 132/39 |

*Primary Examiner*—Paul J. Hirsch

*Attorney, Agent, or Firm*—Charles E. Cates; James H. Phillips; Richard G. Harrer

[57] ABSTRACT

A hair curler system is disclosed which includes a selected length of flexible tubing used in conjuction with one or more flare members and a male coupling member to obtain a configurable assembly for rolling and looping a curl having different incremental diameters along its length. A first flare member is adapted to be partially inserted into one end of the tubing and has an outside diameter which tapers outwardly toward the flare member free end to obtain a graduated diameter along its length. The male coupling member is partially inserted into the opposite end of the tubing and terminates in a bulbous coupling element which is dimensioned and configured to be manually snapped through a reduced diameter neck region within the hollow interior of the first flare member such that, once a curl has been rolled onto the assembly, the assembly may be looped by snapping the coupling element through the reduced diameter neck region for retention during the perming process. Second and third flare members may be selectively employed to provide progressively greater diameters along the assembly length. If the second flare member (or both the second and third flare members) are used in the assembly prepared for a given curl, the coupling member is inserted through these affixes and into the first flare member for securing the loop by engaging the coupling element with the reduced diameter neck region wthin the first flare member.

3 Claims, 1 Drawing Sheet

HAIR CURLER SYSTEM

FIELD OF THE INVENTION

This invention relates to the art of hair curling and, more particularly, to a hair curler system with which a professional beautician or other skilled user obtains the capability for selectively curling an individual curl to graduated nominal diameters along the curl length during a perming process.

BACKGROUND OF THE INVENTION

Professional beauticians and others skilled in the art of preparing hair for a perming process have been more or less limited, as to a given curl, to a given nominal diameter of the curling implement employed to hold the curl during the curling process. As a result, as to each individual curl, a fairly consistent diameter of the curl along its length is obtained, and this restriction limits the range of styling possibilities which the beautician can employ for a given customer. This is a particular problem for long hair in which, in the typical prior art arrangement, a perm rod is used which consists of a flexible tube of uniform diameter with one end of the tube defining a bore and the opposite end of the tube being provided with a reduced diameter boss. To use the rod, a strand of hair is wound in a spiral pattern around the rod which is then bent into a loop in order that the boss may be inserted into the bore to form a closed circle. Perming chemicals are then applied to set the hair in the usual manner. Those skilled in the art will understand that, if a small diameter tube is used, the curls toward the free end of the hair are too tight, giving a kinky, frizzy look. Conversely, if a larger diameter tube is used, the portion of the hair nearest the scalp roots is too loose and does not lie close enough to the scalp Further, as previously mentioned, the stylistic flexibility available to the user is distinctly limited, being substantially restricted to the selection of a diameter and length of tube used in accordance with the hair length.

Thus, those skilled in the art will appreciate that it would be highly desirable to provide a hair curler system, particularly well adapted for long hair, by which a nominal curl diameter can be incrementally changed along its length such that the beautician can enjoy a much wider range of stylistic possibilities in preparing the hair of an individual for the perming process. It is to these ends that my invention is directed.

OBJECTS OF THE INVENTION

It is therefore a broad object of my invention to provide an improved hair curler system.

It is another object of my invention to provide such a hair curler system which may be employed for selectively curler an individual curl to substantially different incremental diameters along the curl length.

It is still another object of my invention to provide such a hair curler system which is readily adaptable to both different curl lengths and different degrees of total nominal curl diameter change in accordance with the preferences of the beautician and the characteristics of an individual curl.

In another aspect, it is an object of my invention to provide such a hair curler system by the selective use of which an individual curl can be rendered loose-to-tight either from the free curl end toward the scalp or from the scalp toward the free curl end.

SUMMARY OF THE INVENTION

Briefly, these and other objects of my invention are achieved by a hair curler system which includes a length of flexible tubing used in conjunction with one or more flare members and a male coupling member. A first flare member is adapted to be partially inserted into one end of the length of flexible tubing and has an outside diameter which tapers outwardly toward the flare member free end to obtain a graduated diameter along its length. The male coupling member is adapted to be partially inserted into the opposite end of the flexible tubing and terminates in a bulbous coupling element which is dimensioned and configured to be manually snapped through a reduced diameter neck region within the hollow interior of the first flare member such that, once a curl has been rolled onto the assembly, the assembly may be looped by snapping the bulbous coupling element through the reduced diameter neck region for retention during the perming process. When the setting step of the perming process has been completed, the coupling element can be manually withdrawn to open the looped assembly and permit removal of the curler assembly. Preferably, the hair curler system also includes second and third flare members. The second flare member is adapted to have its smaller diameter end inserted into the large diameter end of the first flare member and thus provides a still further extent of increased diameter along the assembly length. Similarly, the third flare member is adapted to have its small diameter end abut the large diameter end of the second flare member and thus provides yet a further degree of increased diameter along the assembly length. If the second flare member (or both the second and third flare members) are used in the assembly prepared for a given curl, the male coupling member is inserted through these affixes and into the first flare member for securing the loop by engaging the bulbous coupling element with the reduced diameter neck region within the first flare member as previously described. The flexibility of the system is still further extended by the availability to the operator of different lengths of flexible tubing.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE INVENTION

Figures 1, 2, 3, 4:
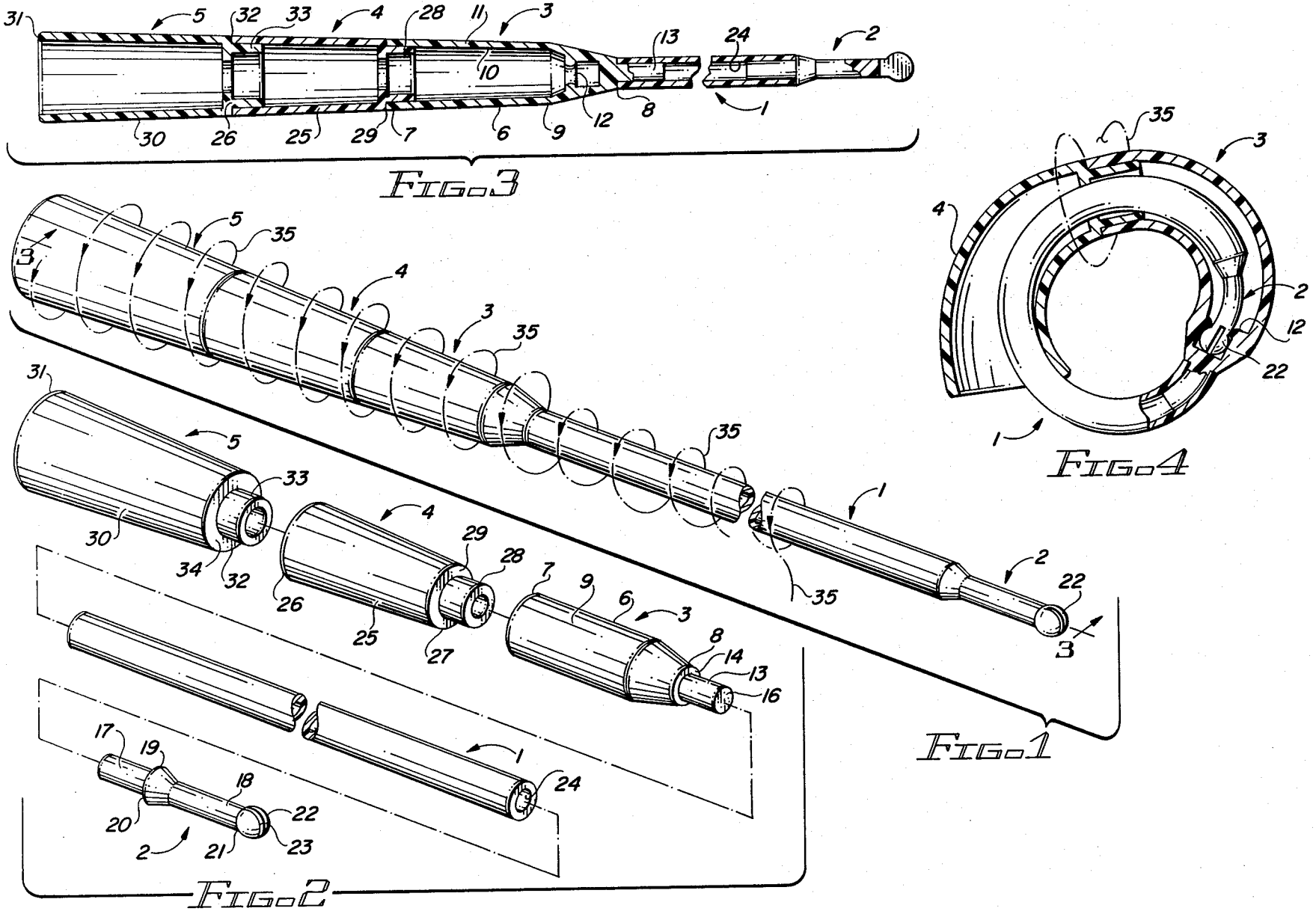
FIG. 1 illustrates the hair curler system in its most complete configuration showing conceptually how a curl may be wrapped onto the curler assembly along its length prior to a looping step in its use.
FIG. 2 is an exploded view illustrating the several interlocking components of the system.
FIG. 3 is a cross sectional view illustrating certain of the internal structure of the several components.
FIG. 4 illustrates the manner in which an exemplary selected set of components of the system may be formed into a loop structure to support a curled length of hair (not shown in the FIG. in the interest of clarity) during a perming process.

Referring simultaneously to FIGS. 1, 2 and 3, it will be observed that the hair curler system according to the present invention includes a length of flexible tubing 1 which may be detachably coupled to a male coupling member and, at the opposite end, to at least one flare member 3. In a presently preferred embodiment of the invention, a second flare member 4 and a third flare member 5 may be selectively employed to extend the capabilities of the system as will be discussed more fully below.

. Referring particularly to FIGS. 2 and 3, the first flare member 3 has a hollow primary body portion 6 having a first end 7 and a second end 8. The outer surface 9 of the primary body portion 6 of the first flare member 3 is normally circular in cross section in the sense that fact exists when the flare member 3 is not distorted during use. Similarly, the inner surface 10 of the primary body portion 6 of the first flare member 3 is normally circular in cross section, and a wall 11 extends between the outer surface 9 and inner surface 10. The material from which the wall 11 is fabricated is readily flexible, and an exemplary material is known in the plastics industry as polyethylene.

The inner surface 10 includes a reduced diameter neck region 12 situated intermediate the length of the primary body portion 6 and preferably offset toward the second end 8 as shown in FIG. 3. The secondary body portion 13 of the first flare member 3 has a first end 14 (which joins the second end 8 of the primary body portion 6 at a shoulder 15) and a second end 16 which is the termination of the first flare member 3. The secondary body portion 13 of the first flare member 3 is provided with a cylindrical outer surface which is smaller than the diameter of the first end 7 and preferably smaller than any outer diameter of the primary body portion 6.

The male coupling member 2 includes a first body portion 17 and a second body portion 18. The first body portion 17 of the male coupling member 2 has a cylindrical outer surface of a diameter which is the same as the diameter of the cylindrical outer surface of the secondary body portion 13 of the first flare member 3. The second body portion 18 of the male coupling member 2 has a first end 19 which joins the first body portion 17 at a shoulder 20, the diameter of the end 19 being larger than the first body portion 17. A second end 21 of the second body portion 18 terminates in a resilient bulbous coupling element 22 which is dimensioned and configured to be manually snapped through the reduced diameter neck region 12 (FIG. 3) for retention thereby as will be discussed in more detail below. The bulbous coupling element 22 may be provided with a transverse slot 23 to facilitate its elastic distortion during the coupling and uncoupling processes.

The second flare member 4 is hollow along its entire length and has a primary body portion 25 extending between a first, larger diameter end 26 of the flare member outer surface to a second, smaller diameter end 27. The inner surface of the second flare member primary body portion 25 is also normally circular in cross section with a wall of flexible material extending between the inner and outer surfaces as previously described with respect to the first flare member 3. A hollow secondary body portion 28 of the second flare member 4 meets the primary body portion 25 at a shoulder 29. The secondary body portion 28 has a cylindrical outer surface which is smaller than the diameter of the outer surface of the primary body portion 25 at its second end 27, and this diameter of the cylindrical outer surface of the secondary body portion 28 is dimensioned to be received by and frictionally engage the inner surface 10 of the primary body portion 6 of the first flare member 3 as particularly well shown in FIG. 3.

Similarly, the third flare member 5 is hollow throughout its length and includes a primary body portion 30 which extends from a first, larger diameter end 31 to a second, smaller diameter end 32 at which it adjoins a still smaller diameter secondary body portion 33 at a shoulder 34. The diameter of the outer surface of the secondary body portion 33 is dimensioned to be received by and frictionally engage the inner surface of the primary body portion of the second flare member 4 at its larger diameter end 26, all as best shown in FIG. 3.

Thus, it will be understood that the respective outer surfaces 6, 25, 30 of the flare members 3, 4, 5 provide a gradually diverging surface (shown to be substantially linear in the FIGS. although that is not a design constraint) to provide an assembly, as shown in FIG. 1, upon which a curl (conceptually represented by the reference number 35) may be rolled such that the curl is secured at different incremental diameters along its length according to the selection of components made by a beautician for a given curl. For relatively short curls, the beautician may elect to use only the three-piece assembly constituting the length of flexible tubing 1 (whose individual length may also be the subject of selection), the male coupling member 2 and the first flare member 3. For intermediate length curls, the second flare member 4 may be added, and for longer yet curls, the third flare member 5 may be employed. Those skilled in the art will appreciate that the addition of even more flare members of progressively graduated diameters may be useful for rolling especially long curls. Further, it may once again be noted that whether the smaller curl region or the larger curl region is to lie next to the scalp is a matter for the discretion of the beautician to obtain the desired effect and result.

Referring also to FIG. 4 (which shows an exemplary curler assembly selected for a fairly short curl for which only a relatively short length of tubing 1 is employed in conjunction with the male coupling member 2, the first flare member 3 and the second flare member 4), once the curl 35 has been coiled onto the curler assembly, the end of the tubing 1 into which the male coupling member 2 has been inserted is entered into the open end of the second flare member 4 and pushed through the flare members 4 3 until the bulbous coupling element 22 engages and is forced past the reduced neck region 12. The curl 35 is then ready to accept the perming solution and undergo the perming process. When the hair has set, it is only necessary to pull the tubing 1 sufficiently to withdraw the bulbous coupling element 22 past the reduced neck portion 12 to uncouple the loop configuration and thereby permit removal of the hair curler assembly from the curl.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A hair curler system for selectively curling an individual curl to substantially different incremental diameters along the curl length, said hair curler system comprising:

(A) a first flare member, said first flare member including:

1. a hollow primary body portion having first and second ends, said primary body portion characterized by an outer surface which is normally circular in cross section and an inner surface which is normally circular in cross section, and a wall of flexible material extending between said inner and outer surfaces, said first end of said primary body portion effecting a first end of said first flare member, said primary body portion extending between a first, larger diameter of said outer surface at said first end thereof and a second, smaller diameter of said outer surface at said second end thereof;
2. a hollow secondary body portion having first and second ends, said first end thereof joining said primary body portion at said second end thereof, said secondary body portion having a cylindrical outer surface, said cylindrical outer surface having a diameter which is smaller than the diameter of said first end of said primary body portion; and
3. a reduced diameter neck region of said inner surface of said primary body portion situated intermediate the length of said primary body portion;

(B) a male coupling member having first and second body portions;

1. said first body portion of said male coupling member having a cylindrical outer surface of a diameter the same as the diameter of said cylindrical outer surface of said secondary body portion of said first flare member; and
2. said second body portion of said male coupling member having first and second ends, said first end thereof joining said first body portion of said male coupling member and said second end thereof terminating in a bulbous coupling element dimensioned and configured to be manually snapped through said reduced diameter neck region of said first flare member and retained thereby until manually withdrawn past said reduced diameter neck region; and (C) a length of flexible tubing having first and second ends and an inside diameter sufficient to receive and frictionally engage said cylindrical outer surface of said secondary body portion of said first flare member and said cylindrical outer surface of said first body portion of said male coupling member;

whereby, said secondary body portion of said first flare member may be inserted into said first end of said length of flexible tubing and said first body portion of said male coupling member may be inserted into said second end of said length of flexible tubing to effect a hair curler assembly having outside diameters along its length which decrease from said first end of said first flare member to said length of flexible tubing such that a curl having different diameters along its length may be wound onto said hair curler assembly after which said hair curler assembly may be formed into a looped configuration by inserting said bulbous element into said first end of said first flare member and manually snapping said bulbous element past said reduced diameter neck region to maintain said hair curler assembly in the looped configuration during a perming process.

2. A hair curler system according to claim 1 which further includes a second flare member, said second flare member including:

(A) a hollow primary body portion having first and second ends, said primary body portion characterized by an outer surface which is normally circular in cross section and an inner surface which is normally circular in cross section, and a wall of flexible material extending between said inner and outer surfaces, said first end of said primary body portion effecting a first end of said second flare member, said primary body portion extending between a first, larger diameter of said outer surface at said first end thereof and a second, smaller diameter of said outer surface at said second end thereof; and (B) a hollow secondary body portion having first and second ends, said first end thereof joining said primary body portion at said second end thereof, said secondary body portion having a cylindrical outer surface, said cylindrical outer surface having a diameter which is smaller than the diameter of said first end of said primary body portion and sufficient to be received by and frictionally engage said inner surface of said hollow primary body portion of said first flare member.

3. A hair curler system according to claim 2 which further includes a third flare member, said third flare member including:

(A) a hollow primary body portion having first and second ends, said primary body portion characterized by an outer surface which is normally circular in cross section and an inner surface which is normally circular in cross section, and a wall of flexible material extending between said inner and outer surfaces, said first end of said primary body portion effecting a first end of said third flare member, said primary body portion extending between a first, larger diameter of said outer surface at said first end thereof and a second, smaller diameter of said outer surface at said second end thereof; and (B) a hollow secondary body portion having first and second ends, said first end thereof joining said primary body portion at said second end thereof, said secondary body portion having a cylindrical outer surface, said cylindrical outer surface having a diameter which is smaller than the diameter of said first end of said primary body portion and sufficient to be received by and frictionally engage said inner surface of said hollow primary body portion of said second flare member.

* * * * *